US009021679B2

(12) United States Patent
Roozeboom

(10) Patent No.: US 9,021,679 B2
(45) Date of Patent: May 5, 2015

(54) MATERIAL REDUCING MACHINE CONVERTIBLE BETWEEN A GRINDING CONFIGURATION AND A CHIPPING CONFIGURATION

(75) Inventor: Keith Roozeboom, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 469 days.

(21) Appl. No.: 13/266,853

(22) PCT Filed: Apr. 27, 2010

(86) PCT No.: PCT/US2010/032547

§ 371 (c)(1),
(2), (4) Date: Oct. 28, 2011

(87) PCT Pub. No.: WO2010/129268

PCT Pub. Date: Nov. 11, 2010

(65) Prior Publication Data

US 2012/0043403 A1 Feb. 23, 2012

Related U.S. Application Data

(60) Provisional application No. 61/173,431, filed on Apr. 28, 2009.

(51) Int. Cl.
*B21D 39/03* (2006.01)
*B02C 9/04* (2006.01)
(Continued)

(52) U.S. Cl.
CPC ..... *B02C 13/286* (2013.01); *B02C 13/06* (2013.01); *B02C 13/2804* (2013.01); *B02C 18/184* (2013.01); *B02C 18/225* (2013.01); *B02C 21/026* (2013.01)

(58) Field of Classification Search
USPC ..... 241/73, 101.1, 189.1, 191, 192; 29/428
See application file for complete search history.

(56) References Cited

U.S. PATENT DOCUMENTS 4,544,105 A 10/1985 Carlsson
5,692,548 A 12/1997 Bouwers et al.
(Continued)

FOREIGN PATENT DOCUMENTS

WO WO 2008/140954 A2 11/2008

*Primary Examiner* — Faye Francis
(74) *Attorney, Agent, or Firm* — Merchant & Gould P.C.

(57) ABSTRACT

The present disclosure relates to a material reducing machine convertible between a grinding configuration and a chipping configuration. The material reducing machine includes a rotary component that is rotatable about an axis of rotation, the rotary component defining a grinding configuration boundary that extends at least partially around the axis of rotation. The material reducing machine also includes a plurality of hammers secured to the rotary component, the hammers including end portions that project outwardly beyond the grinding configuration boundary of the rotary component. Furthermore, the material reducing machine includes a boundary enlarging structure that mounts over the rotary component, the boundary enlarging structure defining a chipping configuration boundary that extends at least partially around the axis of rotation when the boundary enlarging structure is mounted over the rotary component, the chipping configuration boundary being positioned outside the grinding configuration boundary. The boundary enlarging structure is not mounted over the rotary component when the material reducing machine is in the grinding configuration and the boundary enlarging structure is mounted over the rotary component when the material reducing machine is in the chipping configuration.

25 Claims, 15 Drawing Sheets

(51) Int. Cl.

| | |
|---|---|
| ***B02C 13/286*** | (2006.01) |
| ***B02C 13/06*** | (2006.01) |
| ***B02C 13/28*** | (2006.01) |
| ***B02C 18/18*** | (2006.01) |
| ***B02C 18/22*** | (2006.01) |
| ***B02C 21/02*** | (2006.01) |

(56) References Cited

U.S. PATENT DOCUMENTS

| | | | | |
|---|---|---|---|---|
| 6,227,469 | B1 | 5/2001 | Daniels, Jr. et al. | |
| 6,422,495 | B1 | 7/2002 | De Boef et al. | |
| 6,840,471 | B2 | 1/2005 | Roozeboom et al. | |
| 6,843,435 | B2 | 1/2005 | Verhoef et al. | |
| 6,978,955 | B2 | 12/2005 | Verhoef et al. | |
| 7,011,258 | B2 | 3/2006 | O'Halloran et al. | |
| 7,040,558 | B2 | 5/2006 | Stelter et al. | |
| 7,044,409 | B2 | 5/2006 | Stelter et al. | |
| 7,077,345 | B2 | 7/2006 | Byram et al. | |
| 7,204,442 | B2 | 4/2007 | Roozeboom et al. | |
| 7,213,779 | B2 | 5/2007 | Roozeboom et al. | |
| 7,232,083 | B2 | 6/2007 | Stelter et al. | |
| 7,293,729 | B2 | 11/2007 | Ragnarsson | |
| 7,441,719 | B2 | 10/2008 | Verhoef et al. | |
| 7,448,567 | B2 | 11/2008 | Roozeboom et al. | |
| 7,461,802 | B2 | 12/2008 | Smidt et al. | |
| 7,597,279 | B1 | 10/2009 | Stelter et al. | |
| 7,624,937 | B2 | 12/2009 | Stelter et al. | |
| 7,637,444 | B2 | 12/2009 | Stelter et al. | |
| 7,654,479 | B2 | 2/2010 | Stelter et al. | |
| 7,896,274 | B2 | 3/2011 | Roozeboom | |
| 7,959,097 | B2 | 6/2011 | De Boef | |
| 7,959,099 | B1 * | 6/2011 | Cox et al. | 241/294 |
| 7,971,818 | B2 | 7/2011 | Smidt et al. | |
| 8,066,213 | B2 * | 11/2011 | Marquardsen | 241/242 |
| 8,104,701 | B2 * | 1/2012 | Smidt et al. | 241/32 |
| 2002/0190148 | A1 | 12/2002 | Roozeboom et al. | |
| 2005/0184178 | A1 | 8/2005 | Smidt et al. | |
| 2008/0061176 | A1 | 3/2008 | Smith | |
| 2010/0206973 | A1 | 8/2010 | Cotter et al. | |

* cited by examiner

MATERIAL REDUCING MACHINE CONVERTIBLE BETWEEN A GRINDING CONFIGURATION AND A CHIPPING CONFIGURATION

This application is a National Stage Application of PCT/US2010/032547, filed Apr. 27, 2010, which claims priority to benefit of U.S. Provisional Patent Application Ser. No. 61/173,431, filed Apr. 28, 2009 and which applications are incorporated herein by reference. To the extent appropriate, a claim of priority is made to each of the above disclosed applications.

TECHNICAL FIELD

The present disclosure relates generally to material reducing machines. In particular, the present disclosure relates to material reducing machines such as grinders and chippers.

BACKGROUND

Material reducing machines are used to reduce waste materials such as trees, brush, stumps, pallets, root balls, railroad ties, peat moss, paper, wet organic materials and the like. Two common types of material reducing machines include grinders and chippers. Grinders are typically configured to reduce material through blunt force impactions. Thus, the reduced material product generated by grinders generally has a ground, flattened texture with relatively high fines content. This type of reduced material is typically used as mulch. In contrast to the blunt force action used by grinders, chippers reduce material through a chipping action. The reduced product generated by chippers preferably has a relatively small percentage of fines. This type of chipped reduced product can readily be used as fuel for a burner since the material is more flowable than ground reduced material and can easily be handled by the material processing equipment used to feed fuel to a burner.

Grinders typically include reducing hammers on which replaceable grinding cutters (i.e., grinding tips or grinding elements) are mounted. Grinding cutters generally have relatively blunt ends suitable for reducing material through blunt force impactions. In contrast to the grinding cutters used on grinders, chippers typically include relatively sharp chipping knives configured to reduce material through a cutting/slicing action as opposed to a grinding action. An advantage of grinders is that grinders are generally suited to better tolerate wear than chippers without unduly negatively affecting the performance of the grinders and quality of the product output by the grinders. An advantage of chippers is that the sharpness of the chipping knives allows certain materials (e.g., trees) to be processed more rapidly with less power than would typically be required by a grinder.

SUMMARY

One aspect of the present disclosure relates to a material reducing machine that is convertible between a grinding configuration and a chipping configuration.

Another aspect of the present disclosure relates to a method for converting a rotary component from a grinding component to a chipping component. The method includes mounting chipping knives to the rotary component. The method also includes mounting a boundary enlarging structure around the periphery of the rotary component. The boundary enlarging structure functions to limit or control the chipping bite depth of the chipping knives mounted to the rotary component.

Still another aspect of the present disclosure relates to a material reducing system including a rotary component to which a plurality of hammers are secured. The material reducing system also includes a chipping bite depth control structure that can be mounted to the rotary component to convert the rotary component from a grinding component to a chipping component. By mounting grinding cutters to the rotary component without the presence of the chipping bite depth control structure, the rotary component can function as a grinding component. By replacing the grinding cutters with chipping knives and adding the chipping bite depth control structure to the rotary component, the rotary component can function as a chipping component.

A variety of additional aspects will be set forth in the description that follows. The aspects can relate to individual features and to combinations of features. It is to be understood that both the foregoing general description and the following detailed description are exemplary and explanatory only and are not restrictive of the broad concepts upon which the embodiments disclosed herein are based.

DETAILED DESCRIPTION

Figure 1:
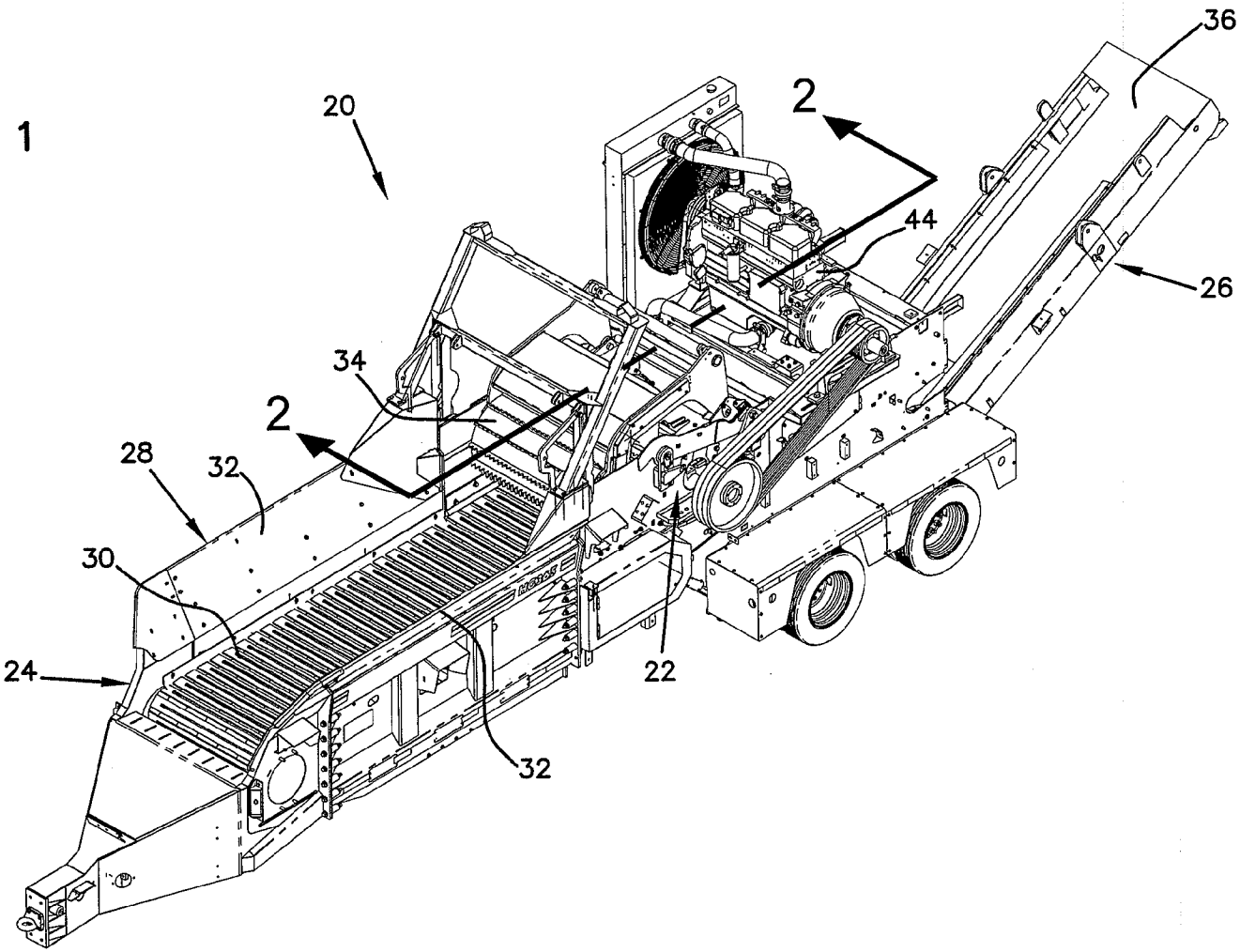
FIG. 1 illustrates a material reducing machine in accordance with the principles of the present disclosure.

The present disclosure relates to a material reducing machine or system that is convertible between a grinding configuration and a chipping configuration. When in the grinding configuration, the material reducing machine is adapted to produce a ground reduced product typically best suited for use as compost or mulch. In contrast, when the material reducing machine is in the chipping configuration, the material reducing machine is adapted to produce a reduced product in the form of chips that can readily be used as fuel chips for a burner operation.

The present disclosure also relates to a material reducing system including a rotary component that is rotatable about an axis of rotation. The rotary component defines a grinding configuration boundary that extends at least partially around the axis of the rotation. A plurality of hammers are secured to the rotary component. The hammers include end portions that project outwardly beyond the grinding configuration boundary of the rotary component. By mounting grinding cutters to the end portions of the hammers, the rotary component can be operated in a grinding mode in which the rotary component is configured to reduce material through a grinding action. In one embodiment, grinding edges of the grinding cutters are positioned at least two and a half inches outwardly beyond the grinding configuration boundary in a radial direction with respect to the axis of rotation. To convert the rotary component from the grinding mode to a chipping mode, the grinding cutters are removed from the hammers and replaced with chipping knives that are mounted to the hammers. Additionally, a boundary enlarging structure is mounted over the rotary component. The boundary enlarging structure defines a chipping configuration boundary that extends at least partially around the axis of rotation of the rotary component when the boundary enlarging structure is mounted over the rotary component. The chipping configuration boundary is positioned outside the grinding configuration boundary. The boundary enlarging structure functions to limit the depth that the chipping knives are able to bite or penetrate into the material being reduced during reducing operations. Specifically, when material such as a tree trunk is fed toward the rotary component, the end of the tree trunk abuts against the boundary enlarging structure as the tree trunk is chipped thereby limiting the bite size of the chipping knives (i.e., the boundary enlarging structure limits the distance the chipping knives can penetrate into the tree trunk). In one embodiment, the chipping edges of the chipping knives are positioned a distance less than or equal to 1.5 inches beyond the boundary enlarging structure in a radial direction with respect to the axis of rotation. The boundary enlarging structure prevents the chipping knives from biting too aggressively into the material being reduced and thereby prevents the rotary component from pulling or drawing the material being reduced into the material reducing chamber at such a rate that the engine may become overloaded.

FIG. 1 shows a material reducing machine 20 in accordance with the principles of the present disclosure. The material reducing machine 20 includes a material reducing chamber 22, a material in-feed arrangement 24 for feeding material desired to be reduced into the material reducing chamber 22, and a material out-feed arrangement 26 for carrying reduced product away from the material reducing chamber 22. The material in-feed arrangement 24 includes a material in-feed trough 28 having a floor 30 and side walls 32 positioned on opposite sides of the floor 30. The floor 30 is defined by a conveying arrangement such as a continuous conveyor (e.g., a belt, chain track or other conveying structure driven in a continuous loop) configured to feed material desired to be reduced into the material reducing chamber 22. The material in-feed arrangement 24 also includes an upper feed roller 34 that cooperates with the conveyor floor 30 to feed material into the material reducing chamber 22. The feed roller 34 can also function to grip material being fed into the material reducing chamber 22 to prevent the material from being pulled too quickly into material reducing chamber 22. The material out-feed arrangement 26 includes a discharge conveyor 36 that typically extends beneath the material reducing chamber 22. When material is reduced within the chamber 22, the material can fall from the material reducing chamber 22 onto the discharge conveyor 36 which carries the reduced product away from the material reducing chamber 22. The discharge conveyor 36 can be used to load the reduced material into a container such as the bed of a truck.

Figure 2:
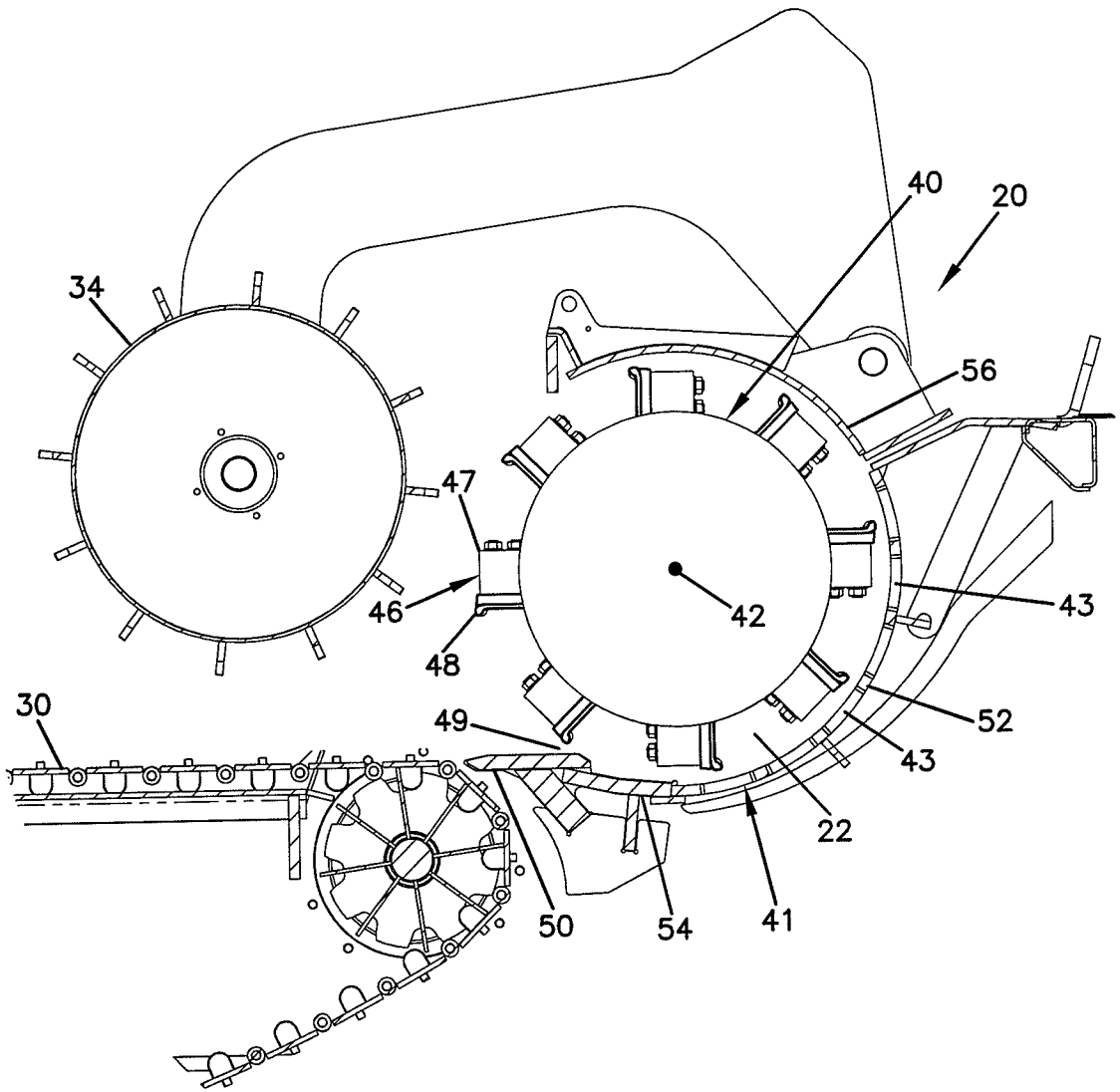
FIG. 2 is a cross-sectional view taken along section line 2-2 of FIG. 1.

Referring to FIG. 2, the material reducing machine 20 includes a rotary component 40 positioned within the material reducing chamber 22. The rotary component 40 is rotatable about a central longitudinal axis of rotation 42. Power for rotating the rotary component can be provided by an engine 44 (see FIG. 1) coupled to the rotary component 40 by a torque transferring arrangement (e.g., an arrangement of sheaves, belts, gears, shafts, chains or other known structures). A plurality of hammers 46 are mounted to the rotary component 40. As shown at FIG. 2, a plurality of grinding cutters 48 are mounted to the hammers 46. The material reducing chamber 22 is defined by a surround or enclosure 41 that surrounds at least a portion of the rotary component 40. The enclosure 41 includes an anvil 50 that cooperates with outer portions of the grinding cutters 48 of the rotary component 40 to define an in-feed nip or gap 49 for material desired to be reduced to be fed into the material reducing chamber 22. The enclosure 41 also includes a sizing screen 52 that extends around a portion of the rotary component 40. The sizing screen 52 defines a plurality of sizing openings 43 through which material reduced in the material reducing chamber 22 passes before falling onto the discharge conveyor 36. The enclosure 41 further includes a transition plate 54 and a top cover plate 56. The transition plate 54 extends from the anvil 50 to a leading edge 51 of the sizing screen 52. The top cover plate 56 that extends from a trailing 53 edge of the sizing screen 52 over a top side of the rotary component 40.

Figure 3:
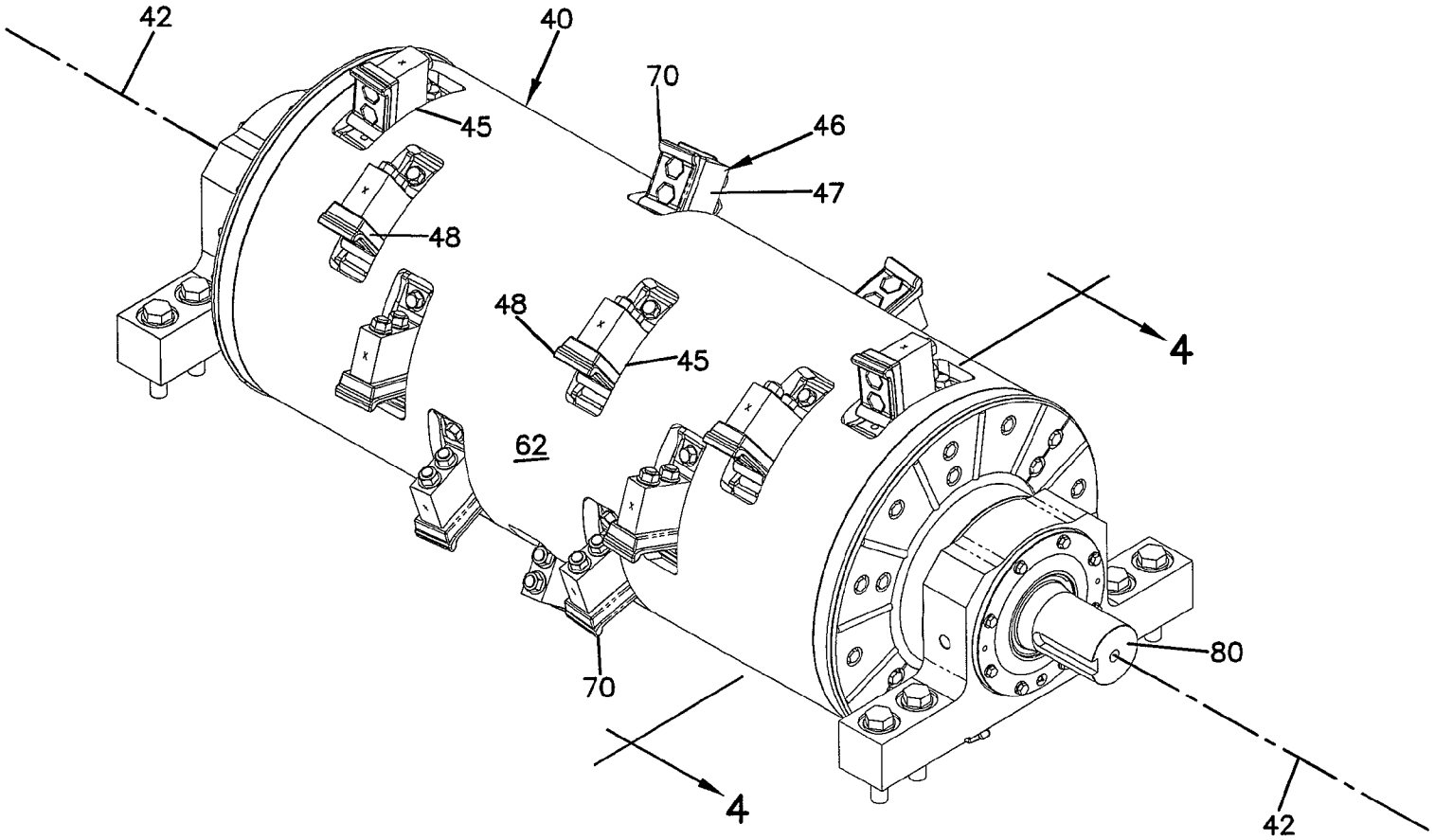
FIG. 3 is a perspective view of a rotary component used in the material reducing machine of FIG. 1.

Referring to FIG. 3, the rotary component 40 includes a drive shaft 80 that is preferably connected to the frame of the reducing machine via a bearing arrangement. In use, torque from the engine 44 is transferred from the engine to the drive shaft 80 to cause the rotary component 40 to be rotated about the axis of rotation 42. The axis of rotation 42 extends longitudinally through the center of the drive shaft 80.

In use of the material reducing machine 20, material desired to be reduced is loaded into the material in-feed arrangement 24. The material in-feed arrangement 24 then feeds the material against the rotary component 40 while the rotary component 40 is rotated about the axis of rotation 42 in a counterclockwise direction as shown by arrow 73 provided at FIG. 2. As the material desired to be reduced is fed against the rotary component 40, the cutters 48 mounted on the hammers 46 engage the material initially reducing the material and forcing the material through the in-feed gap 49 between the anvil 50 and the rotary component 40. Once inside the material reducing chamber 22, the material is further reduced by the cutters 48 and forced through the sizing holes 43 in the sizing screen 52. From the sizing screen 52, the reduced material falls to the discharge conveyor 36 of the out-feed arrangement 26. The discharge conveyor 36 carries the reduced material to a material collection location.

Figure 4:
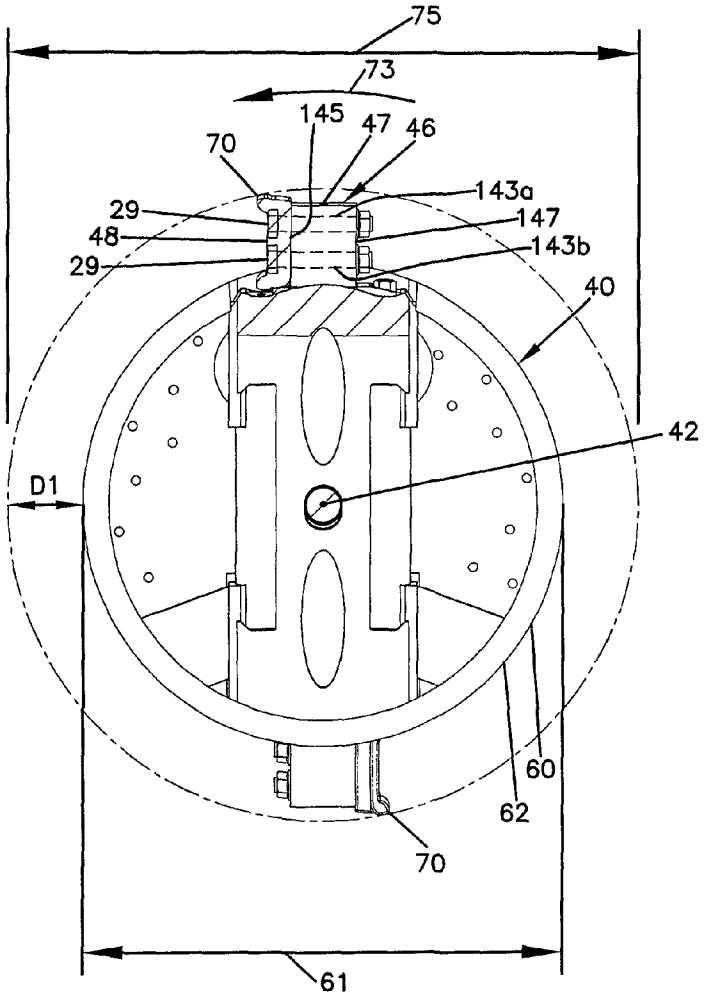
FIG. 4 is a cross-sectional view taken along section line 4-4 of FIG. 3.
Figure 5:
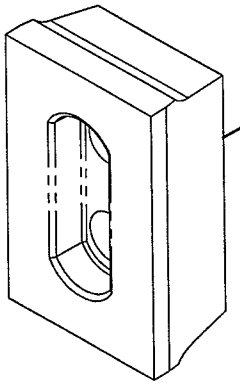
FIGS. 5-8 show several example grinding cutters that can be used with the rotary component of FIG. 3.
Figure 6:
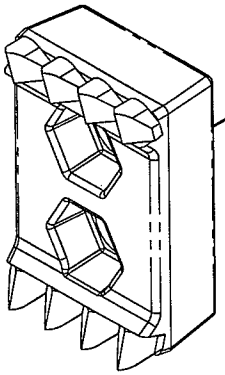
Figure 7:
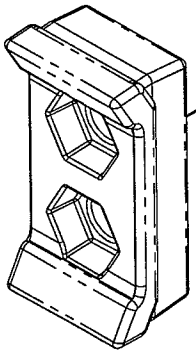
Figure 8:
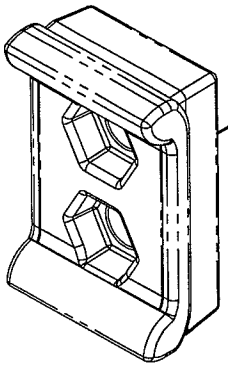

FIGS. 3 and 4 show the rotary component 40 in isolation from the remainder of the material reducing machine 20. As depicted in FIGS. 3 and 4, the rotary component 40 is in a grinding configuration (i.e., a grinding mode). In the grinding configuration, the grinding cutters 48 are mounted to end portions 47 of the hammers 46. The end portions 47 of the hammers 46 project radially outwardly beyond a grinding configuration boundary 60 of the rotary component 40. In the embodiment of FIGS. 3 and 4, the rotary component 40 has a drum-shaped configuration including a generally cylindrical outer drum skin 62 (i.e., an outer shell, cover or wall) that extends along the length of the rotary component 40. The drum skin 62 extends around the axis of rotation 42 and is depicted as being concentric with the axis of rotation 42. The outer surface of the drum skin 62 defines the grinding configuration boundary 60. The grinding configuration boundary 60 defines a grinding configuration boundary diameter 61.

Referring still to FIGS. 3 and 4, the hammers 46 are mounted to the rotary component 40 at hammer mounting locations 45. The hammers 46 extend through the hammer mounting locations 45 and the end portions 47 of each hammer 46 are located on diametrically opposite sides of the rotary component 40. The hammers 46 are spaced axially relative to one another along the length of the rotary component 40 and are angularly offset from one another about the axis of rotation 42. The grinding cutters 48 mounted to the end portions 47 include outer edges 70 adapted to impact material fed into the material reducing chamber 22. When the rotary component 40 is rotated about the axis of rotation 42 (e.g., in a counterclockwise direction as shown by arrow 73 at FIG. 4), the outer edges 70 of the grinding cutters move along a grinding cutter edge path 72 positioned outside the grinding configuration boundary 60. The grinding cutter edge path 72 defines a grinding cutter edge path diameter 75. The grinding cutter edge path 72 is spaced a distance D1 outwardly from the grinding configuration boundary 60 in a radial direction. In one embodiment, the distance D1 is equal to or greater than 2.5 inches.

It will be appreciated that a number of different grinding cutter configurations can be mounted to the end portions 47 of the hammers 46. FIGS. 5-8 show four different styles of grinding cutters 48*a*-48*d* that can be mounted to the hammers 46. It will be appreciated that the type of grinding cutter selected is dependent upon the type of material being reduced and the type of reduced product desired to be output from the material reducing machine 20. It will also be appreciated that the depicted grinding cutters are shown merely to depict different styles of grinding cutters, and that other types of grinding cutters can be used as well without departing from the principles of the present disclosure.

Figure 9:
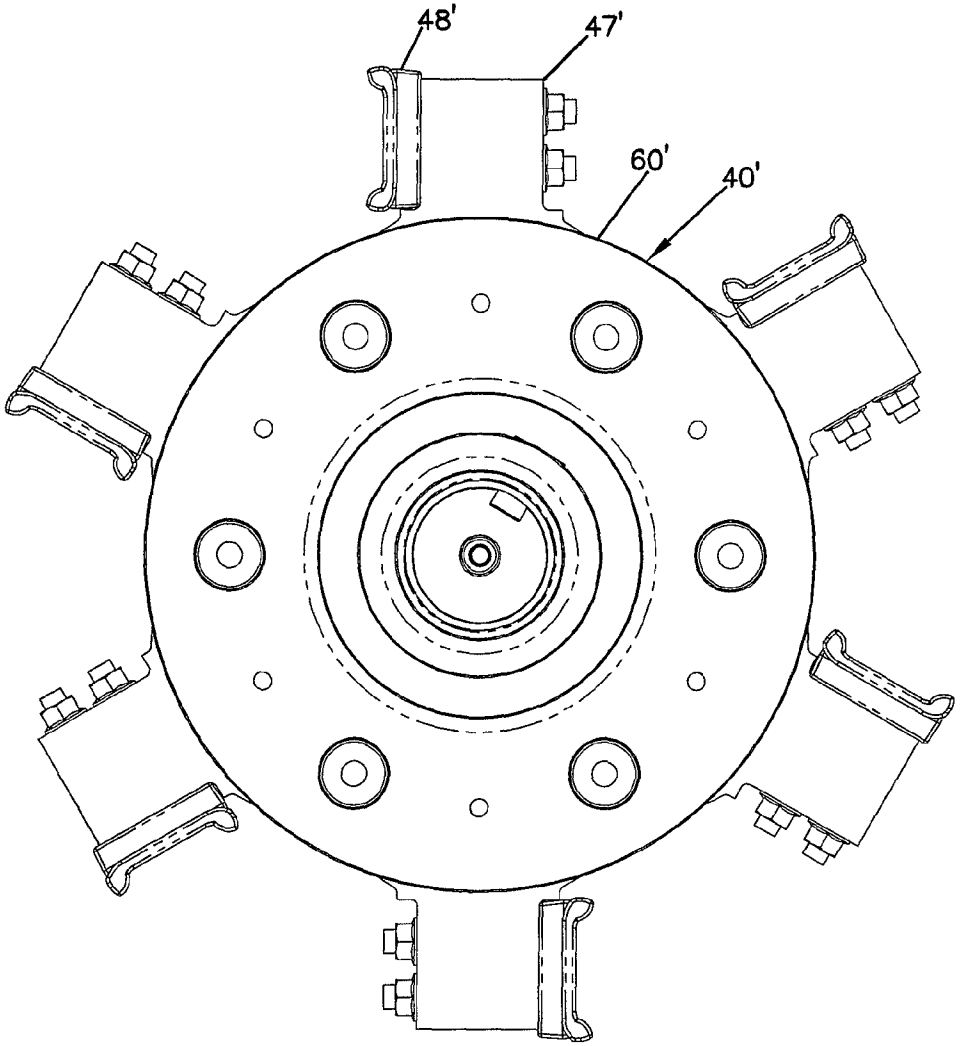
FIG. 9 is an end view of an alternative rotary component that can be used with the material reducing machine of FIG. 1.
Figure 10:
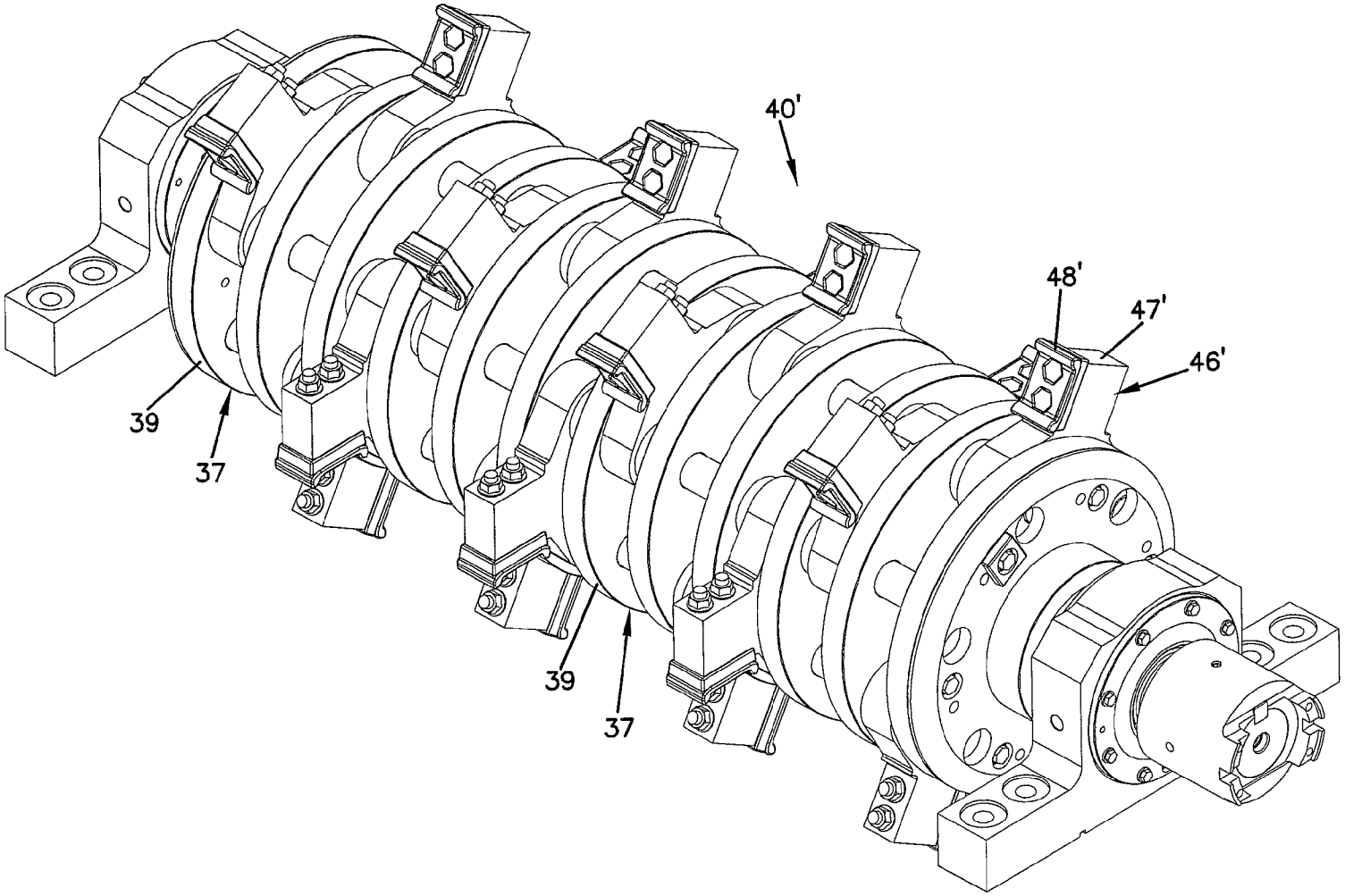
FIG. 10 is a perspective view of the rotary component of FIG. 9.

FIGS. 9 and 10 show an alternative rotary component 40' that can also be used with the rotary reducing machine 20. The rotary component 40' includes a plurality of plates or discs 37 between which hammers 46' are mounted. Outer circumferential surfaces 39 of the plates define a grinding configuration boundary 60' of the rotary component 40'. End portions 47' of the hammers 46' project outwardly beyond the grinding configuration boundary 60' in a radial direction. Cutters 48' are mounted to the end portions 47'.

As used herein, the phrase "mounted to" includes direct mounting configurations and indirect mounting configurations. An indirect mounting configuration is a mounting configuration in which one part is secured to another part through the use of one or more intermediate parts.

Figure 11:
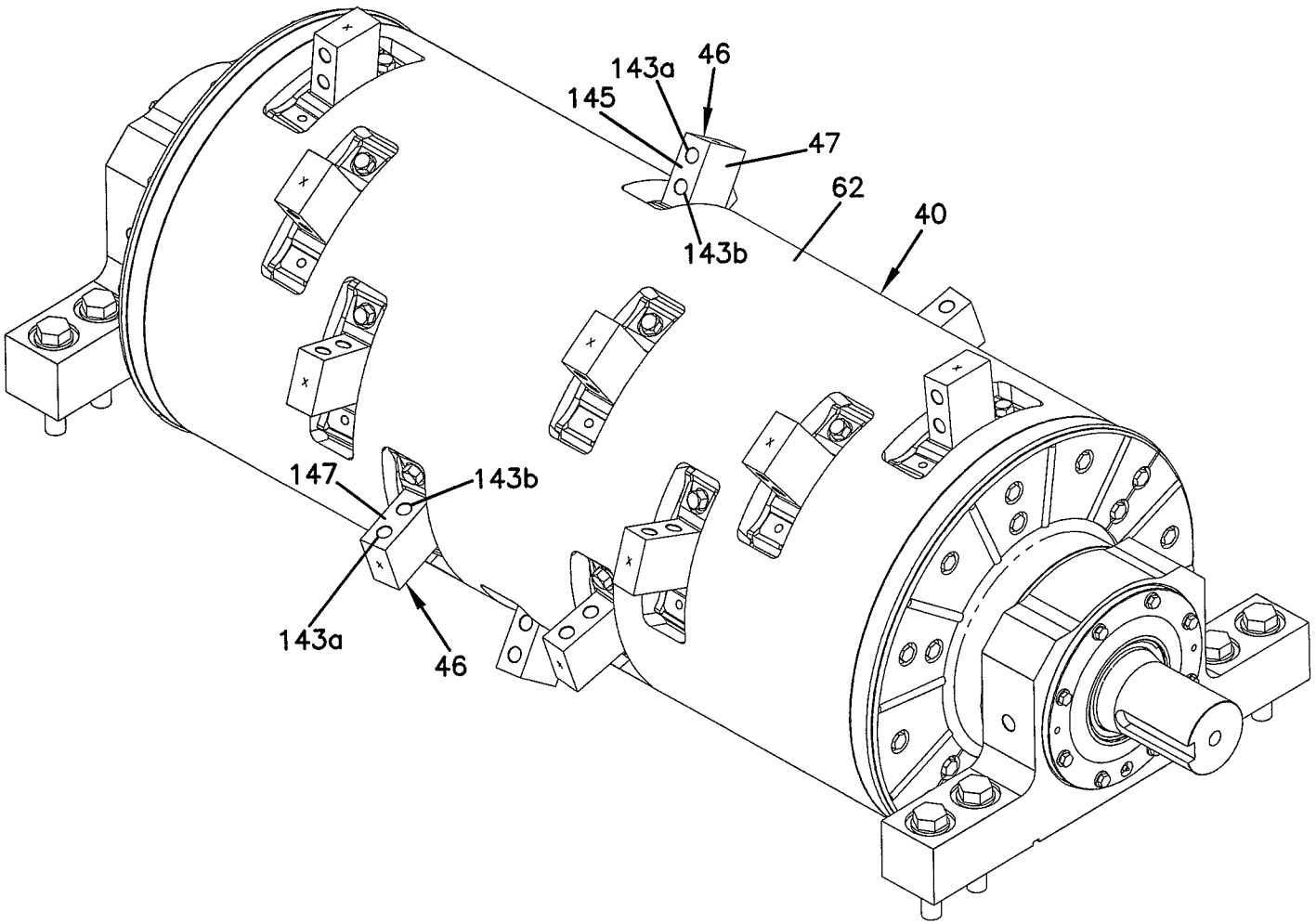
FIG. 11 shows the rotary component of FIG. 3 with the grinding cutters removed from the hammers of the rotary component.

To convert the rotary component 40 from a grinding configuration (e.g., the configuration of FIG. 3) to a chipping configuration (e.g., the configuration of FIG. 12), the grinding cutters 48 are removed as shown in FIG. 11. A boundary enlarging structure 100 is then mounted over the rotary component 40. When mounted over the rotary component 40, a fed material stop 39 (e.g., an outer circumferential surface or outer circumferential surfaces) of the boundary enlarging structure 100 defines a chipping configuration boundary 102 (see FIG. 13*a*) that extends at least partially around the axis of rotation 42. The chipping configuration boundary 102 has a chipping configuration boundary diameter 103 that is larger than the grinding configuration boundary diameter 61. In one embodiment, the chipping configuration boundary 102 is spaced outwardly in a radial direction from the grinding configuration boundary 60 by a distance D2 that is at least one inch. It will be appreciated that the boundary enlarging structure 100 preferably can be mounted over the rotary component 40 without requiring the rotary component 40 to be removed from the material reducing chamber 22 of the material reducing machine 20.

Figure 12:
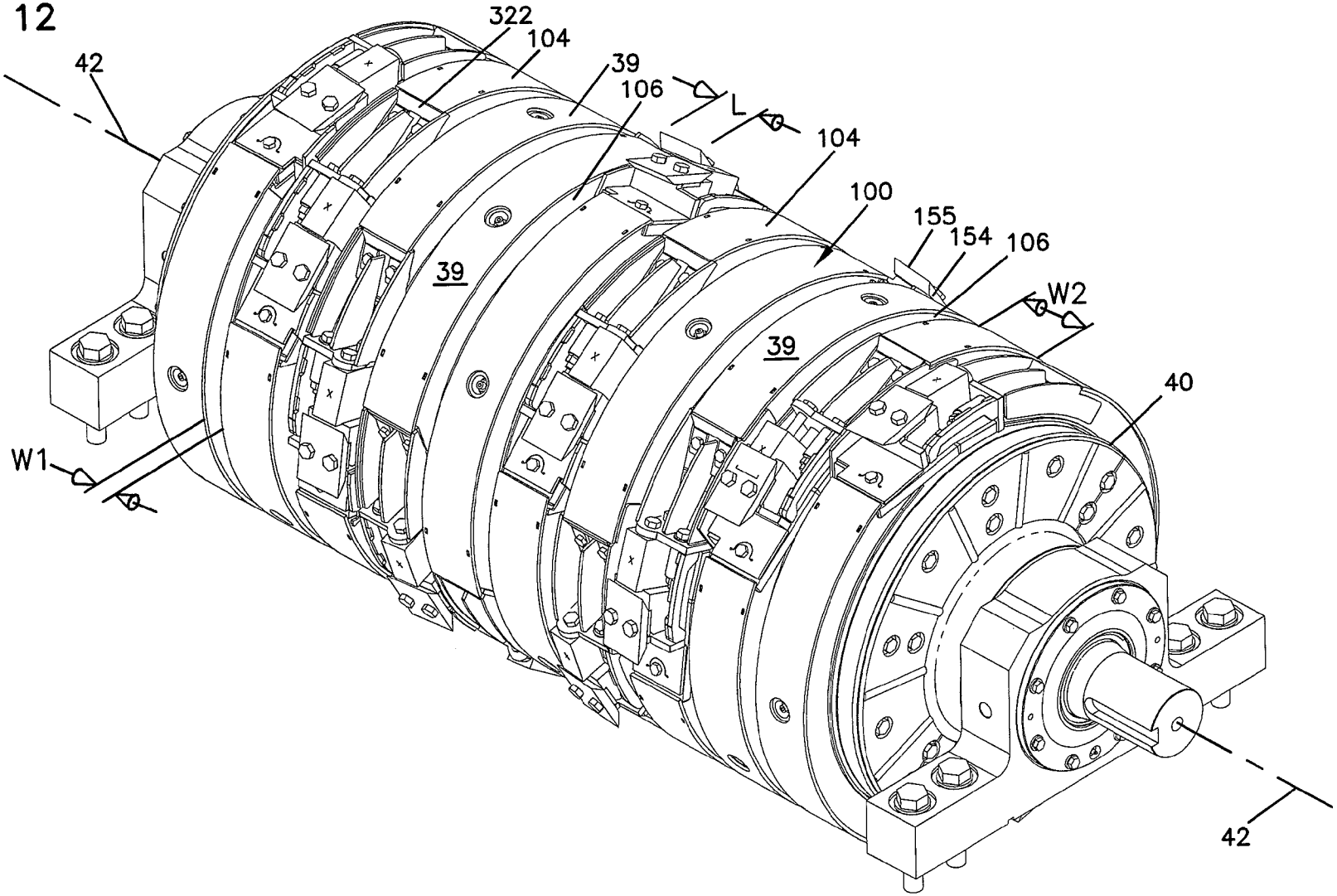
FIG. 12 is a perspective view of the rotary component of FIG. 3 fitted with chipping knives and a boundary enlarging structure that functions to control/limit the depth at which the chipping knives can bite/penetrate into material being reduced by the rotary component.
Figure 13:
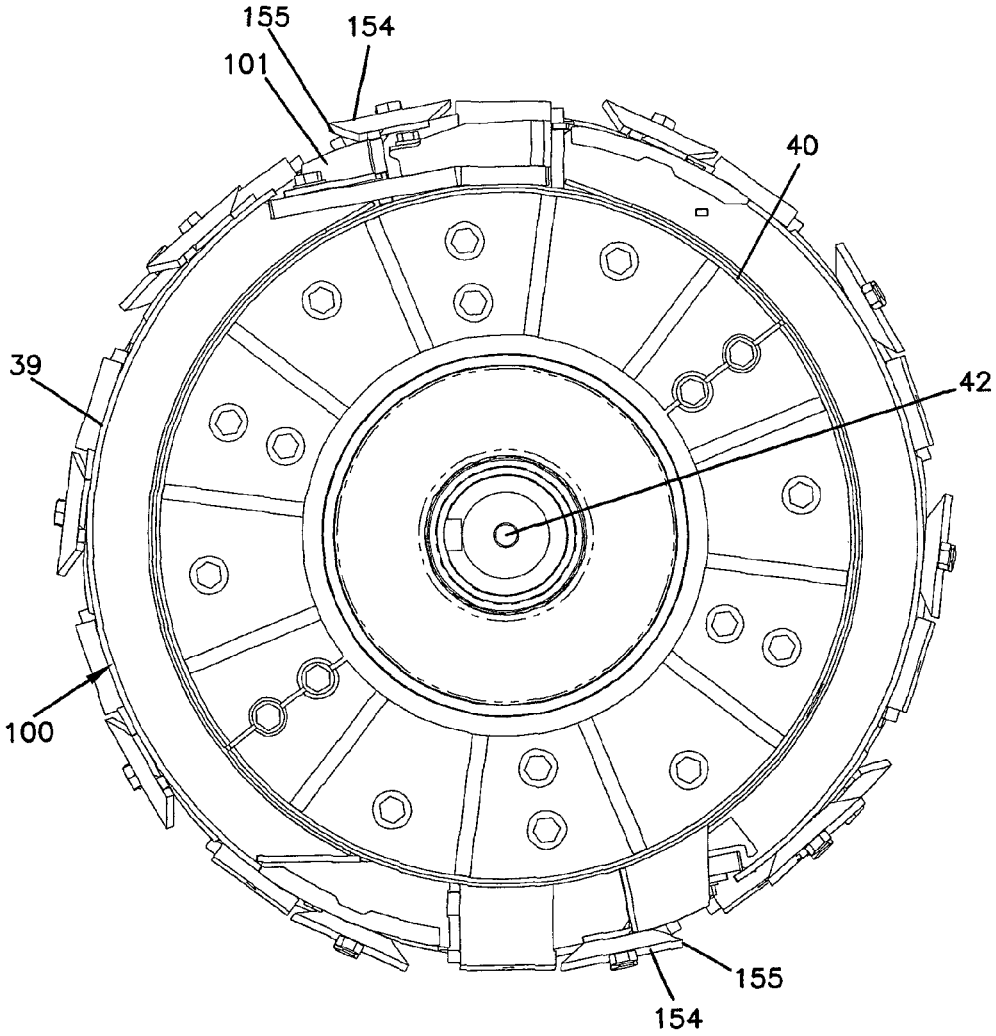
FIG. 13 is an end view of the rotary component of FIG. 3 fitted with the boundary enlarging structure and chipping knives.

Referring to FIGS. 12 and 13, the boundary enlarging structure 100 also defines a plurality of chipping pockets 101 that are recessed inwardly relative to the chipping configuration boundary 102. Chipping knives 154 are mounted to the hammers 46 adjacent the chipping pockets 101. The chipping knives 154 include chipping edges 155 that are positioned outside the chipping configuration boundary 102 and that overhang the chipping pockets 101. When the rotary component 40 is rotated about the axis of rotation 42 (e.g., in a counterclockwise direction as shown by arrow 73 at FIG. 13), the chipping edges 155 move along a circular chipping edge path 157 (shown at FIG. 13*a*) positioned outside the chipping configuration boundary 102. The chipping edge path 157 defines a chipping edge path diameter 159. The chipping edge path 157 is spaced a distance D3 outwardly from the chipping configuration boundary 102 in a radial direction. In one embodiment, the distance D3 is less than or equal to 1.5 inches. In other embodiments, it is preferred for the distance D3 to be less than or equal to 1.25 inches. In still other embodiments, it is desired for the distance D3 to be less than or equal to 1 inch. It will be appreciated that the distance D3 can be greater or less than the spacings provided above depending upon the chipping action desired by the operator and the material being reduced.

In use of the material reducing machine 20 while the rotary component 40 is in the chipping configuration, the rotary component 40 is rotated about the axis of rotation 42 in the direction defined by arrow 73. Concurrently, material desired to be reduced is loaded into the material in-feed arrangement 24. The material in-feed arrangement 24 then feeds the material against the rotary component 40 while the rotary component 40 is rotated about the axis of rotation 42. As the material desired to be reduced is fed against the rotary component 40, the chipping knives 154 mounted to the hammers 46 penetrate into the material and generate chips which are at least temporarily received in the chipping pockets 101. At least some of the chips are carried through the in-feed gap 49 between the anvil 50 and the rotary component 40 via the chipping pockets 101. Contact between the material being fed against the rotary component 40 and the fed material stop 39 of the boundary enlarging structure 100 prevents the chipping knives 154 from penetrating too deeply into the material being reduced. Once inside the material reducing chamber 22, the material may be further reduced by the chipping knives 154 and may pass through the sizing holes in the sizing screen 52. Some material also may be carried by the rotary component 40 over the top of the rotary component 40 back to the in-feed gap 49 for re-processing. From the sizing screen 52, the reduced material falls to the discharge conveyor 36 of the out-feed arrangement 26. The discharge conveyor 36 carries the reduced material to a material collection location.

Figure 14:
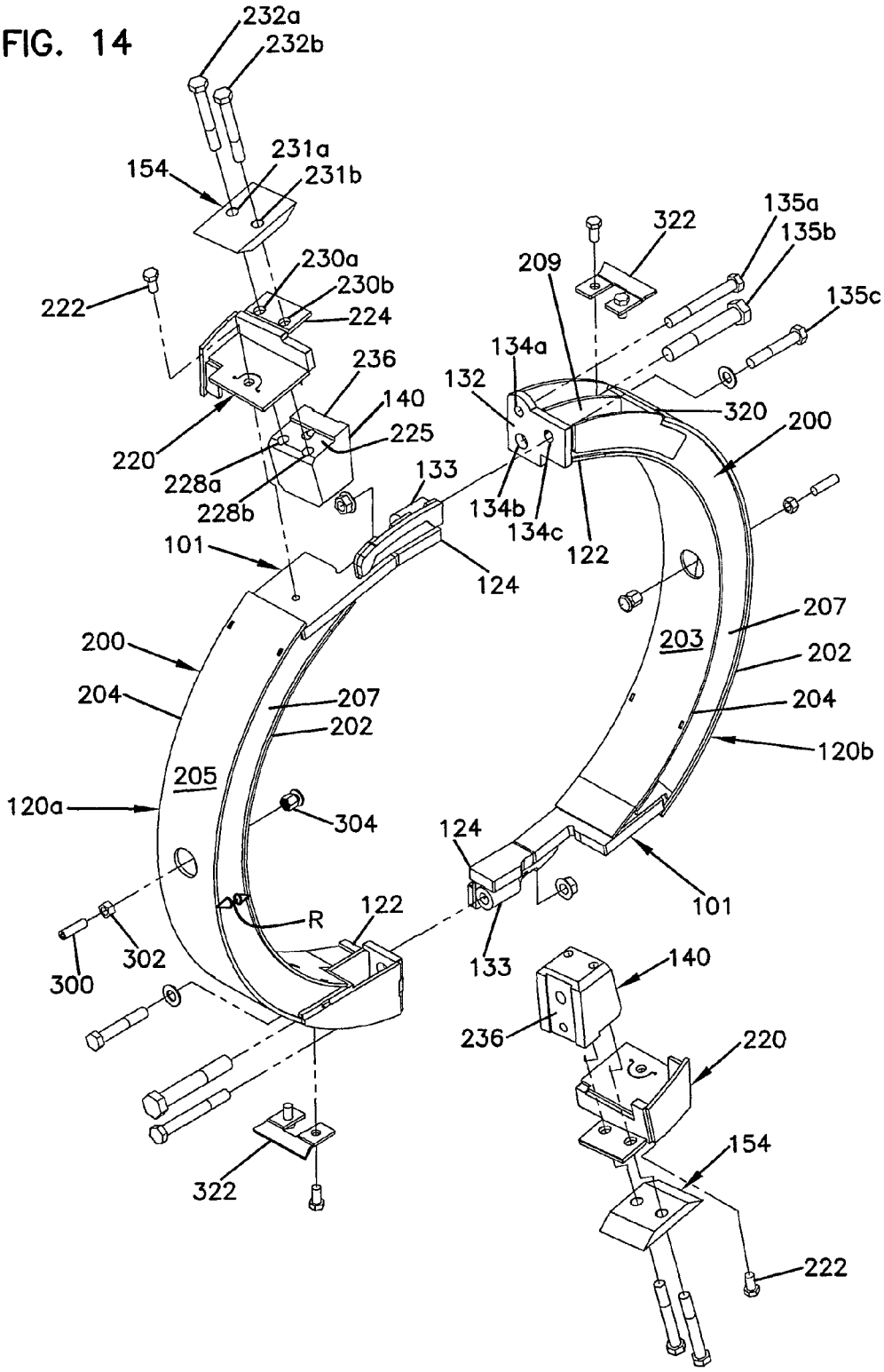
FIG. 14 is an exploded, perspective view of one of the rings of the boundary enlarging structure of FIG. 12.

Referring to FIGS. 12 and 14, the boundary enlarging structure 100 is formed by a plurality of boundary enlarging rings 104 that mount over the rotary component 40. The boundary enlarging rings 104 are positioned around the drum skin 62 in a side-by-side arrangement along a length of the rotary component 40 (i.e., along the axis of rotation 42). The boundary enlarging rings 104 can be separated along the length of the rotary component 40 by annular, axial gaps 106. Widths W1 of the gaps 106 extend in a direction parallel to the axis of rotation 42.

Figure 15:
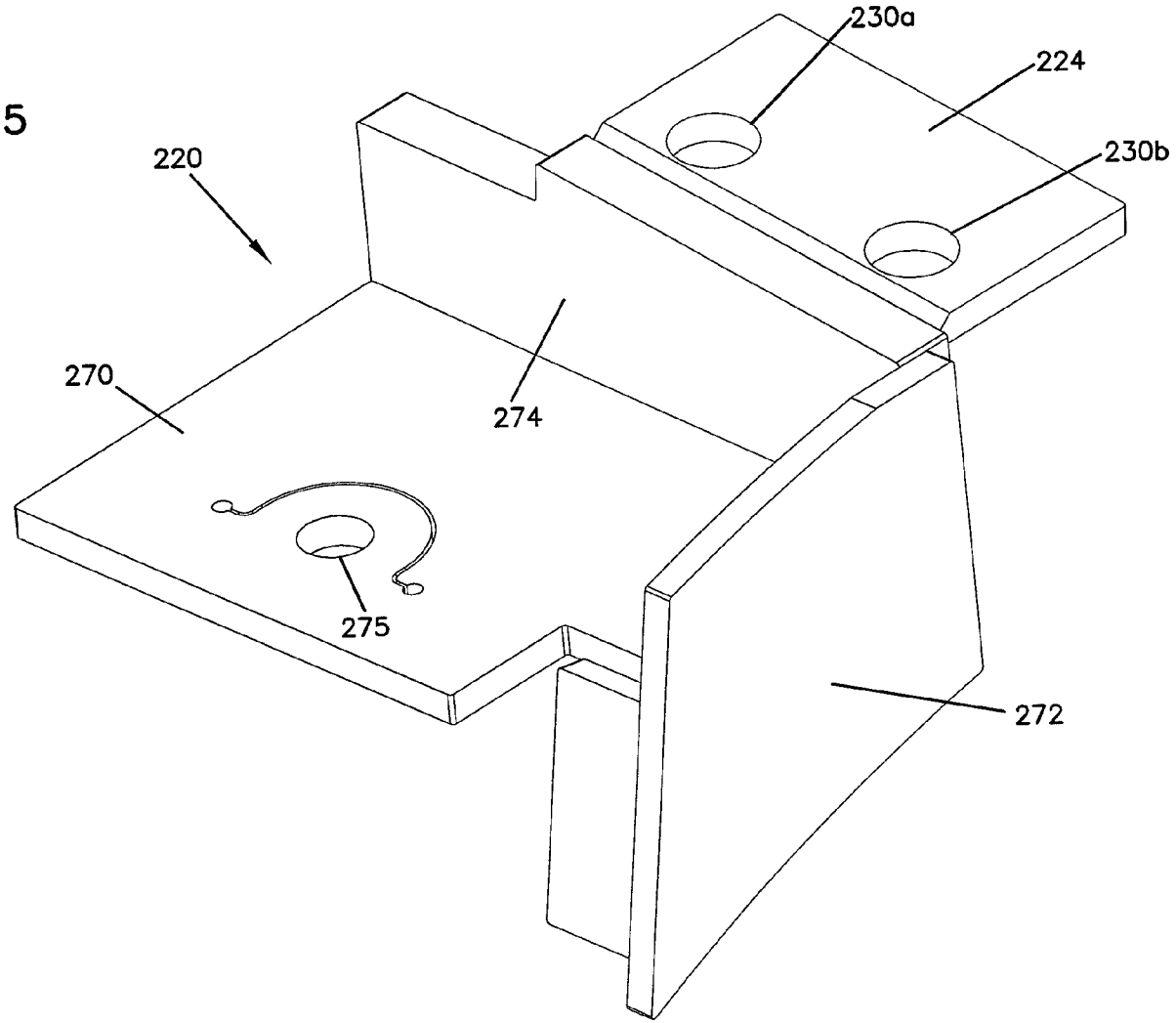
FIG. 15 is a perspective view of a protective cover incorporated into the design of the boundary enlarging structure of FIG. 12.

As shown at FIG. 14, the boundary enlarging rings 104 are preferably each formed by at least two separate, partial ring components 120*a*, 120*b* or ring portions that are connected together around the exterior of the rotary component 40. As shown in FIG. 15, the ring components 120*a*, 120*b* are depicted as half pieces. It will be appreciated that the term "half piece" includes a piece that forms half of a boundary enlarging ring or approximately half the boundary enlarging ring. Therefore, half pieces in accordance with the principles of the present disclosure can be slightly larger or slightly smaller than half of the boundary enlarging ring defined by the half pieces.

Each of the partial ring components 120*a*, 120*b* includes a main partial ring body 200 including an inner circumferential wall 202 spaced from an outer circumferential wall 204 by a radial spacing/thickness R. Each main partial ring body 200 includes a first end 122 positioned opposite from a second end 124. The first and second ends 122, 124 are positioned approximately 180° apart from one another. The inner circumferential wall 202 of each main partial ring body 200 includes an inner cylindrical surface 203 and the outer circumferential wall 204 includes an outer cylindrical surface 205. When two of the partial ring components 120*a*, 120*b* are connected together around the rotary component 40, the inner cylindrical surfaces 203 face toward the axis of rotation 42 and the outer cylindrical surfaces 205 face away from the axis of rotation 42. The outer circumferential surfaces 205 of the multiple boundary enlarging rings 104 mounted on the rotary component 40 cooperate to form the fed material stop 39 that defines the chipping configuration boundary 102 of the boundary enlarging structure 100. The boundary enlarging rings 104 also define the chipping pockets 101 that recess inwardly from the chipping configuration boundary 102. The pockets provide a region of open volume for receiving chips produced by the chipping knives 154 upon contact with the material desired to be reduced.

In one embodiment, the radial spacing/thickness R of the main partial ring body 200 is preferably at least one inch in magnitude. In another embodiment, the radial spacing/thickness R is at least 1.5 inches in magnitude. Side walls 207 are secured adjacent side edges of the circumferential walls 202, 204 to maintain the radial spacing/thickness R.

A number of structures are provided for use in coupling together two of the partial ring components 120*a*, 120*b* and for securing the partial ring components to the end portions 47 of the hammers 46. Example, structures include fastening plates 132, fastening tunnels 133, knife mounting blocks 140 and fasteners 135*a-c* (e.g., bolts). The fastening plates 132 are secured (e.g., welded) at the first ends 122 of the main partial ring bodies 200 and fastening tunnels 133 and knife mounting blocks 140 are secured (e.g., welded) at the second ends 124 of the main partial ring bodies 200. When the partial ring components 120*a*, 120*b* are secured to the rotary component 40, the end portions 47 of the hammers 46 are captured between the fastening plates 132 and the knife mounting blocks 140. The fastening plates 132 define mounting openings 134*a*, 134*b* that respectively align with corresponding openings 143*a*, 143*b* defined through the end portions 47 of the hammers 46. The knife mounting blocks 140 also define openings 141*a*, 141*b* that respectively co-axially align with the openings 143*a*, 143*b*. Mounting fasteners 135*a*, 135*b* (e.g., bolts) are respectively secured within the sets of co-axially aligned openings 134*a*, 143*a*, 141*a* and 134*b*, 143*b* and 141*b* to secured the fastening plates 132 and the knife mounting blocks 140 to the end portions of the hammers 46.

The fastening plates 132 also define openings 134*c* that align with opening 137*c* of the fastening tunnels 1330 when the when the partial ring components 120*a*, 120*b* are secured to the rotary component 40. Fasteners 135*c* are inserted through the openings 134*c* and into the openings 137*c* to further fasten the first and second ends 122, 124 of the partial ring components 120*a*, 120*b* together. When inserted through the mounting openings 134*a-c*, portions of the fasteners 135*a-c* (e.g., heads of the fasteners) are positioned within fastener access compartments 209 located at the first ends 122 of the main partial ring bodies 200. In one embodiment, the openings 137*c*, 141*a*, 141*b* can include internal threads that interlock/mate with external threads provided at the ends of the respective fasteners 135*a-c*.

In one embodiment, the knife mounting blocks 140 are attached to the second ends 124 of the main partial ring bodies 200 by removable protective covers 220. The protective covers 220 are attached to the main partial ring bodies 200 by fasteners 222 and include block attachment plates 224 that are positioned over outer surfaces 226 of the knife mounting blocks 140. The block attachment plates 224 fit within notched regions 225 defined by the knife mounting blocks 140. The knife mounting blocks 140 define knife mounting openings 228*a*, 228*b* for use in mounting the chipping knives 154 to the knife mounting blocks 140. The openings 228*a*, 228*b* are provided at the outer surfaces 226 of the blocks 140 and respectively align with corresponding openings 230*a*, 230*b* of the block attachment plates 224. The chipping knives 154 also define openings 231*a*, 231*b* that respectively align with the openings 228*a*, 228*b* and 230*a*, 230*b*. Fasteners 232*a*, 232*b* extend through the openings 231*a*, 231*b* and 230*a*, 230*b* and are secured within the openings 228*a*, 228*b* of the blocks 140 to mount the chipping knives 154 and the protective covers 220 to the blocks 140. In one embodiment, the blocks 154 also define channels 236 for receiving the end portions 47 of the hammers 46 when the partial ring components 120*a*, 120*b* are mounted to the rotary component 40.

To mount the boundary enlarging rings 104 to the rotary component 40, the grinding cutters 48 are first removed from the end portions 47 of the hammers 46. As shown at FIG. 4, the grinding cutters 48 are secured to the end portions 47 of the hammers by fasteners 29 that extend through the openings 143*a*, 143*b* defined through the end portions 47 of the hammers 46. The openings 143*a*, 143*b* extend through the end portions 47 of the hammers 46 from leading faces 145 to trailing faces 147 of the end portions 47 of the hammers 46. By removing the fasteners 29 from the openings 143*a*, 143*b*, the grinding cutters 48 can be removed from the hammers 46.

Once the grinding cutters 48 have been removed as shown at FIG. 11, the boundary enlarging rings 104 can be mounted over the drum skin 62 of the rotary component 40 as shown at FIG. 12. To mount a selected one of the boundary enlarging rings 104 to the rotary component 40, the partial ring components 120*a*, 120*b* are positioned on diametrically opposite sides of the rotary component 40 with the inner cylindrical surfaces 203 facing radially inwardly toward the axis of rotation 42. The partial ring components 120*a*, 120*b* are preferably positioned in alignment with a selected hammer mounting location 45 of the rotary component 40. The partial ring components 120*a*, 120*b* are then brought together such that the rotary component 40 is trapped/captured between the partial ring components 120*a*, 120*b*.

When the partial ring components 120*a*, 120*b* are brought together, the end portions 47 of the hammers 46 are captured between the fastening plates 132 at the first ends 122 of the partial ring components 120*a*, 120*b* and the knife mounting blocks 140 at the second ends of the partial ring components 120*a*, 120*b*. Specifically, the fastening plates 132 oppose the trailing faces 147 of the hammers 46 and the leading faces 145 of the hammers 46 fit within the channels 236 defined by the knife mounting blocks 140. As so positioned, the openings 137*c* of the tunnels 133 co-axially align with the openings 134*c* of the fastener plates 132. Additionally, the openings 134*a*, 134*b* of the fastener plates 132 co-axially align with the openings 143*a*, 143*b* through the end portions 47 of the hammers 46 also co-axially align with the openings 141*a*, 141*b* of the knife mounting blocks 140. By inserting the fasteners 135*c* through the openings 134*c* and securing the ends of the fasteners 135*c* within the openings 137*c*, the first and second ends 122, 124 of the partial ring components 120*a*, 120*b* are attached together. Additionally, by inserting the fasteners 135*a*, 135*b* through the openings 134*a*, 134*b*, 143*a*, 143*b* and securing the ends of the fasteners 135*a*, 135*b* within the openings 141*a*, 141*b*, the first and second ends 122, 124 of the partial ring components 120*a*, 120*b* are secured to the end portions 47 of the hammers 46. By this mounting configuration, the chipping knife mounting blocks 140 are also used to mount the chipping knives 154 to the end portions of the hammers 46. The chipping knives 154 can be secured to the knife mounting blocks 140 by 232*a*, 232*b* prior to mounting the partial ring components 120*a*, 120*b* about the rotary component 40.

The rotary component 40 can be converted back to the grinding configuration by removing the boundary enlarging rings 104 and by re-mounting the grinding cutters 48 on the end portions 47 of the hammers 46. The boundary enlarging rings 104 can be easily removed by using the access compartment 209 to gain access to the fasteners 135*a-c*. The fasteners 135*a-c* can be removed to free the first and second ends 122, 124 of the partial ring components 120*a*, 120*b*. The partial ring components 120*a*, 120*b* can then be pulled apart from one another and removed from the rotary component. The chipping knives 154 and protective covers 220 can be removed along with the other parts of the ring components 120*a*, 120*b* so as to leave the end portions 47 of the hammers 46 exposed.

Figure 13A:
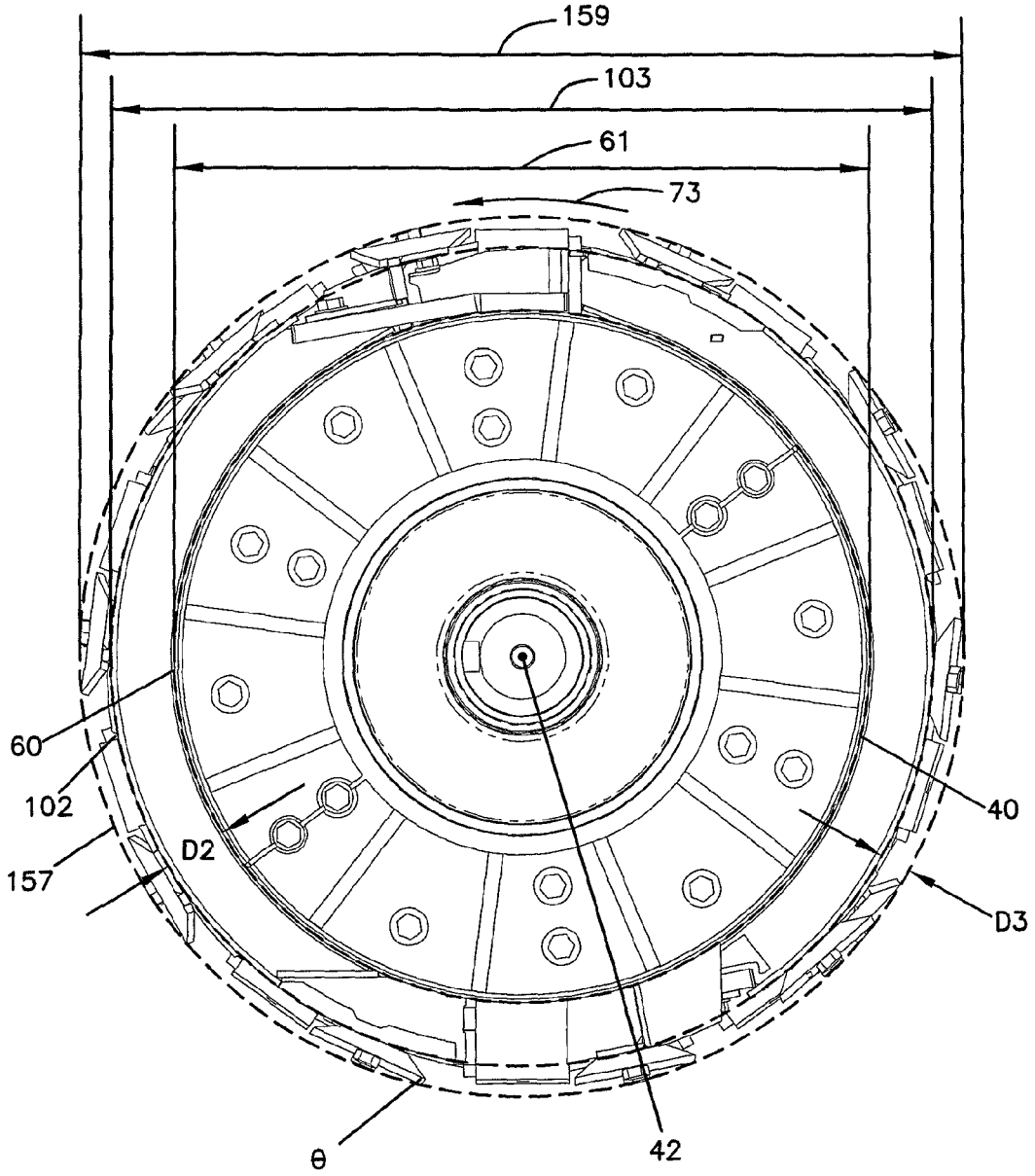
FIG. 13*a* is an annotated version of FIG. 13 showing various boundaries labeled.

The chipping knives 154 are preferably configured to reduce material through a chipping action. Referring to FIG. 13*a*, the chipping knives 154 preferably have a cutting edge angle θ less than 60°. In another embodiment, the cutting edge angle θ is less than 45°. In still another embodiment, the cutting edge angle θ is in the range of 10° to 60°. In still a further embodiment, the cutting edge angle θ is in the range of 10° to 45°. In still a further embodiment, the cutting edge angle θ is in the range of 20° to 40°. In still another embodiment, the cutting edge angle θ is about 30°.

The chipping edges 155 of the chipping knives 154 can define lengths L (see FIG. 12) that extend in a direction along the axis of rotation 42. In one embodiment, the lengths L of the chipping knife edges 155 are less than or equal to axial widths W2 of the boundary enlarging rings 104. In this or other embodiments, at least portions of the boundary enlarging rings 104 are axially offset/staggered from their corresponding chipping knives 154. In this way, the chipping knives 154 will not cut grooves in the material being reduced that allow the boundary enlarging rings 104 to nest or otherwise fit into the grooves. If this were to occur, the distance the chipping knives 154 penetrate into the material being reduced could become greater than desired. The above-described design ensures that the material being ground impacts against the exterior of the boundary enlarging rings 104 during chipping. Thus, the exterior portions of the boundary enlarging rings 104 defining the chipping configuration boundary 102 function as a stop that prevents the material being reduced from being pulled too far beneath the chipping knives 154 and prevents the chipping knives from penetrating too deeply into the material being reduced.

The removable protective covers 220 function to secure the knife mounting blocks 140 to the main partial ring bodies 200, and also function to protect portions of the boundary enlarging rings 104 from excessive wear. For example, referring to FIGS. 12, 14 and 15, the protective covers 220 include pocket protection plates 270 that cover the pockets of the boundary enlarging rings 104. The fasteners 222 extend through openings 275 in the pocket protection plates 270 to secure the protective covers 220 to the main partial ring bodies 200 of the partial ring components 120*a*, 120*b*. The protective covers 220 also include adjacent ring protection plates 272 configured to protect adjacent boundary enlarging rings from wear in the area adjacent the pockets. The protective covers 220 also include block protection plates 274 that extend from the pocket protection plates 270 to the block attachment plates 224 and function to protect leading faces of the knife mounting blocks 140 from wear. The protective covers 220 are secured to the main partial ring bodies 200 with fasteners that allow the wear covers 220 to be readily removed and replaced when worn.

The boundary enlarging rings 104 also include set screws 300 that extend in a radial direction through the main partial ring bodies 200. The set screws 300 are threaded through an internally threaded mount 302 (i.e., a nut) secured to each main partial ring body 200 at a location between the inner and outer circumferential walls. By threading the set screws 300 within the internally threaded mounts 302, inner ends of the set screws 300 can be compressed against the drum skin 62 to push the partial ring body 200 away from the outer surface of the drum. The inner ends of the set screws 300 can include swivel feet/pads 304 that engage the drum skin 62. In this way, the set screws 300 can be used to center the rings 104 around the drum and can provide a snug relationship between the boundary enlarging rings 104 and the drum to limit rattling.

Figure 16:
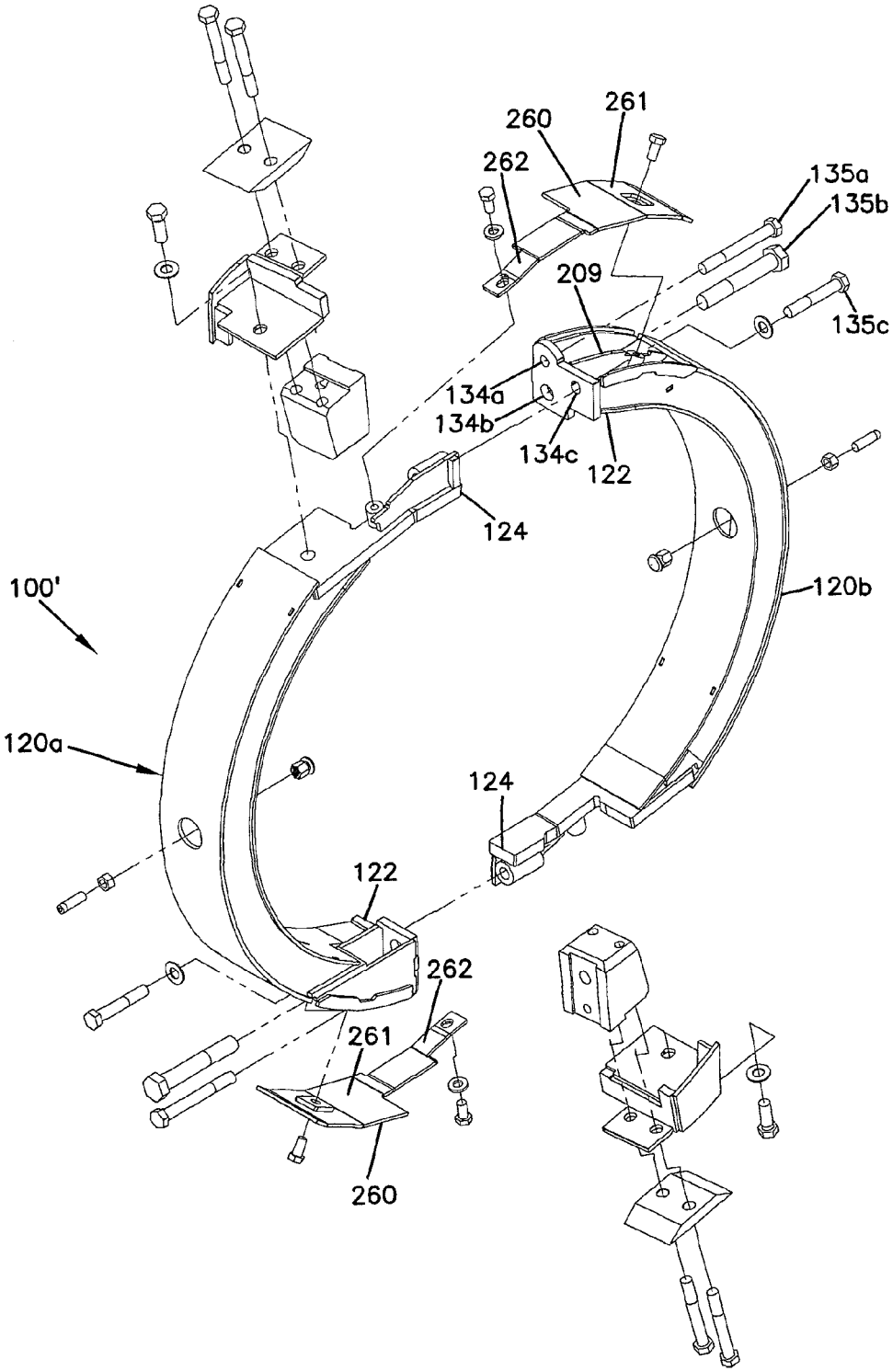
FIG. 16 is a perspective view of an alternative boundary enlarging structure.
Figure 17:
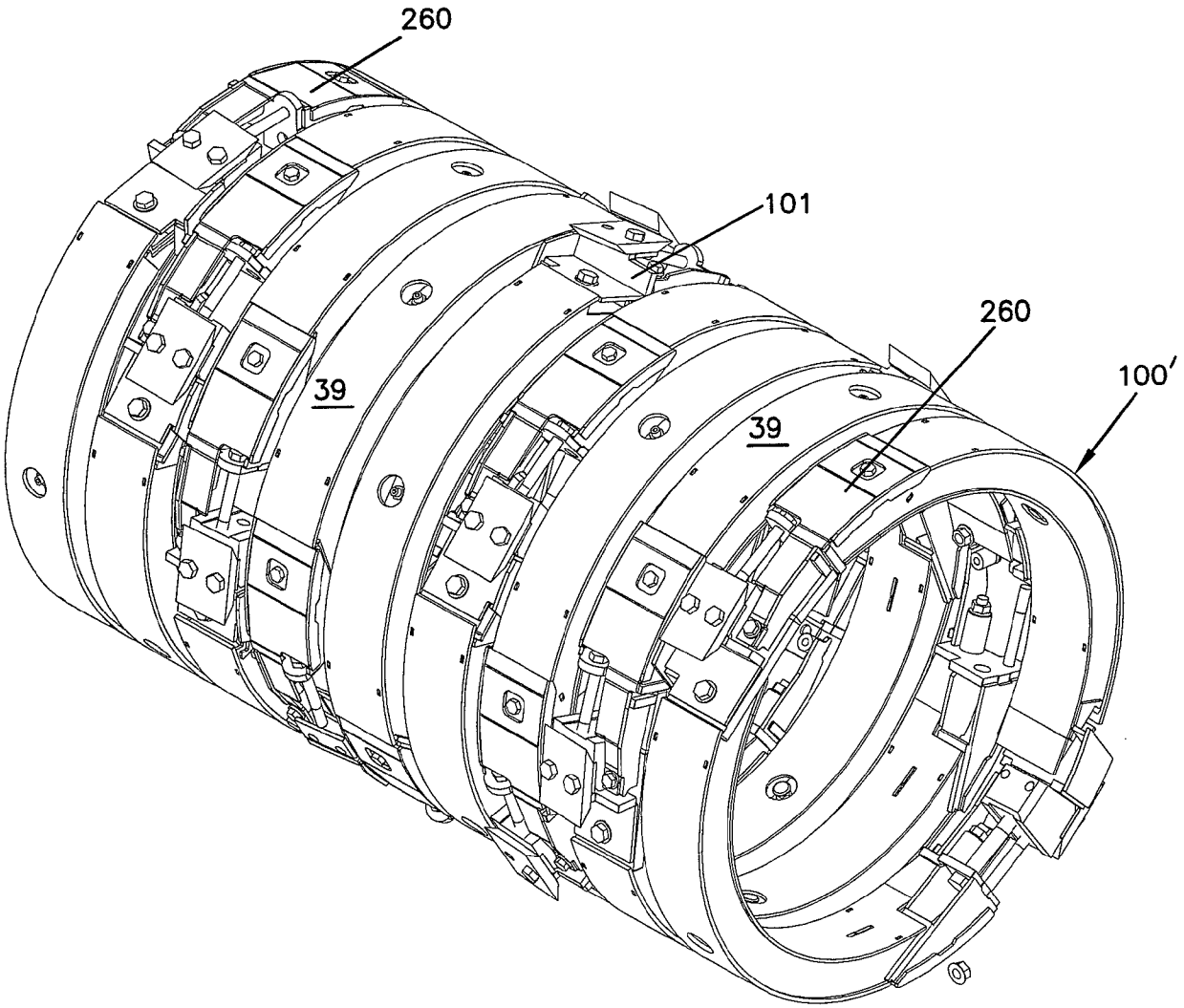
FIG. 17 is an exploded, perspective view of one of the rings of the boundary enlarging structure of FIG. 16.

Referring back to FIG. 14, the main partial ring bodies 200 include edges 320 that trail directly behind the chipping knives 154. At this location, the edges 320 can encounter excessive wear. To prevent this from happening, removable wear plates 322 are mounted at the first ends 122 of the partial ring components 120*a*, 120*b* over the edges 320. FIGS. 16 and 17 show an alternative boundary enlarging structure 100' having the same basic structure as the boundary enlarging structure 100 except access compartments 209 are enclosed by cover plates 260 that can be mounted to the to the partial ring components 120*a*, 120*b* to cover and protect the fasteners 135*a-c*. The fastener cover plates 260 include enlarged portions 261 that cover the fastener access compartments 209. The fastener cover plates 260 also include strip portions 262 that project outwardly from the enlarged portions 261. The strip portions 262 extend across the interfaces between the first and second ends 122, 124 of the partial ring components 120*a*, 120*b* and function to cover the fasteners 135*c* and the tunnels 133.

The preceding embodiments are intended to illustrate without limitation the utility and scope of the present disclosure. Those skilled in the art will readily recognize various modifications and changes that may be made to the embodiments described above without departing from the true spirit and scope of the disclosure.

What is claimed is:

1. A material reducing machine convertible between a grinding configuration and a chipping configuration, the material reducing machine comprising:

a rotary component that is rotatable about an axis of rotation, the rotary component defining a grinding configuration boundary that extends at least partially around the axis of rotation;

a plurality of hammers secured to the rotary component, the hammers including end portions that project outwardly beyond the grinding configuration boundary of the rotary component;

a boundary enlarging structure that mounts over the rotary component, the boundary enlarging structure defining a chipping configuration boundary that extends at least partially around the axis of rotation when the boundary enlarging structure is mounted over the rotary component, the chipping configuration boundary being positioned outside the grinding configuration boundary;

wherein the boundary enlarging structure is not mounted over the rotary component when the material reducing machine is in the grinding configuration and the boundary enlarging structure is mounted over the rotary component when the material reducing machine is in the chipping configuration.

2. The material reducing machine of claim 1, wherein grinding cutters are mounted to the hammers when the material reducing machine is in the grinding configuration, and wherein chipping knives are mounted to the hammers when the material reducing machine is in the chipping configuration.

3. The material reducing machine of claim 2, wherein the grinding cutters have grinding edges defining a grinding edge path when the rotary component is rotated about the axis of rotation, wherein the chipping knives have chipping edges defining a chipping edge path when the rotary component is rotated about the axis of rotation, wherein the grinding edge path is spaced a first distance outwardly from the grinding configuration boundary, wherein the chipping edge path is spaced a second distance outwardly from the chipping configuration boundary, and wherein the first distance is larger than the second distance.

4. The material reducing machine of claim 3, wherein the second distance is less or equal to 1.5 inches.

5. The material reducing machine of claim 4, wherein the first distance is greater than or equal to 2.5 inches.

6. The material reducing machine of claim 1, wherein the rotary component includes a drum having a generally cylindrical outer surface defining the grinding configuration boundary.

7. The material reducing machine of claim 3, wherein the boundary enlarging structure includes a plurality of boundary enlarging ring components mounted over the rotary component, the boundary enlarging ring components having outer, generally cylindrical surfaces that define the chipping configuration boundary, wherein the boundary enlarging ring components are separated from one another on the rotary component by axial gaps, wherein the chipping edges of the chipping knives have lengths that extend along he axis of rotation, and wherein at least portions of the generally cylindrical surfaces are at least axially offset from the lengths of the chipping edges.

8. The material reducing machine of claim 1, wherein the boundary enlarging structure includes a plurality of boundary enlarging ring components mounted over the rotary component, the boundary enlarging ring components having outer, generally cylindrical surfaces that define the chipping configuration boundary.

9. The material reducing machine of claim 8, wherein the boundary enlarging ring components are separated from one another on the rotary component by axial gaps.

10. The material reducing machine of claim 8, wherein the boundary enlarging ring components are secured to the end portions of the hammers.

11. The material reducing machine of claim 8, wherein the boundary enlarging ring components each include two half-shells that are mounted over the rotary component, the half-shells having end portions that are coupled together to retain the boundary enlarging ring structures to the rotary component.

12. The material reducing machine of claim 11, wherein the end portions of the half-shells are coupled together by fasteners that extend through the end portions of the hammers.

13. The material reducing machine of claim 8, wherein the boundary enlarging ring components include knife mounting blocks that mount to the end portions of the hammers, and wherein chipping knives are mounted to the hammers via the knife mounting blocks.

14. The material reducing machine of claim 13, wherein the end portions of the hammers have leading surfaces that lead the hammers when the rotary component is rotated about the axis of rotation, wherein the knife mounting blocks are mounted in front of the leading surfaces of the hammers, and wherein the chipping knives are secured to radially outwardly facing surfaces of the mounting blocks.

15. The material reducing machine of claim 8, wherein the boundary enlarging ring components define chipping pockets that recess inwardly from the chipping configuration boundary, and wherein chipping knives are mounted adjacent the chipping pockets.

16. The material reducing machine of claim 15, further comprising removable protective shielding mounted at the chipping pockets.

17. A material reducing machine convertible between a grinding configuration and a chipping configuration, the material reducing machine comprising:

a drum that is rotatable about a central longitudinal axis of rotation, the drum including an outer skin defining a generally cylindrical grinding configuration boundary that extends at least partially around the axis of rotation, the drum including a length that extends along the axis of rotation;

a plurality of hammers secured to the drum, the hammers including end portions that project outwardly beyond the grinding configuration boundary of the drum, the hammers being secured to the drum at hammer mounting locations positioned along the length of the drum;

a boundary enlarging structure that mounts over the drum, the boundary enlarging structure defining a chipping configuration boundary that extends at least partially around the axis of rotation when the boundary enlarging structure is mounted over the drum, the chipping configuration boundary being positioned outside the grinding configuration boundary, and the boundary enlarging structure including a plurality of boundary enlarging rings that mount over the drum, the boundary enlarging rings being positioned in a side-by side arrangement along the length of the drum when mounted to the drum;

wherein the boundary enlarging structure is not mounted over the drum when the material reducing machine is in the grinding configuration and the boundary enlarging structure is mounted over the drum when the material reducing machine is in the chipping configuration.

18. The material reducing machine of claim 17, wherein the boundary enlarging rings are separated along the length of the drum by axial gaps.

19. A method for converting a material reducing machine from a grinding configuration to a chipping configuration, the material reducing machine including a rotary component that is rotatable about an axis of rotation, the rotary component defining a grinding configuration boundary that extends at least partially around the axis of rotation, the material reducing machine also including a plurality of hammers secured to the rotary component, the hammers including end portions that project outwardly beyond the grinding configuration boundary of the rotary component, the material reducing machine further including grinding cutters secured to the end portions of the hammers when the material reducing machine is in the grinding configuration, the method comprising:

removing the grinding cutters from the rotary component;

mounting a boundary enlarging structure around the rotary component, the boundary extending structure defining a chipping configuration boundary that extends at least partially around the axis of rotation, the chipping configuration boundary being positioned outside the grinding configuration boundary; and mounting chipping knives to the rotary component, wherein the boundary enlarging structure assists in controlling a bite size of the chipping knives.

20. The method of claim 19, wherein the chipping knives are mounted to the end portions the hammers via mounting blocks secured to the end portions of the hammers.

21. A material reducing machine convertible between a grinding configuration and a chipping configuration, the material reducing machine comprising:

a rotary component that is rotatable about an axis of rotation, the rotary component defining a grinding configuration boundary that extends at least partially around the axis of rotation;

a boundary enlarging structure that mounts over the rotary component, the boundary enlarging structure defining a chipping configuration boundary that extends at least partially around the axis of rotation when the boundary enlarging structure is mounted over the rotary component, the chipping configuration boundary being positioned outside the grinding configuration boundary;

wherein the boundary enlarging structure is not mounted over the rotary component when the material reducing machine is in the grinding configuration and the boundary enlarging structure is mounted over the rotary component when the material reducing machine is in the chipping configuration.

22. The material reducing machine of claim 21, wherein the boundary enlarging structure is defined by a plurality of boundary enlarging segments that each extend only partially around a circumference of the rotary component, the boundary enlarging segments having boundary defining surfaces that face radially outwardly from the axis of rotation of the rotary component and that cooperate to define the chipping configuration boundary.

23. A material reducing machine comprising:

a rotary component that is rotatable about an axis of rotation; and a removable boundary enlarging structure that mounts over the rotary component, the boundary enlarging structure including a plurality of boundary enlarging segments that mount to the rotary component, the boundary enlarging segments being sized and shaped such that each boundary enlarging segments coincides with only a portion of a length of the rotary component and only a portion of a circumference of the rotary component, the boundary enlarging segments having boundary defining surfaces that face radially outwardly from the axis of rotation of the rotary component and that cooperate to define a chipping boundary of the material reducing machine; and a plurality of chipping blades having chipping edges positioned radially outside chipping boundary.

24. A method for converting a material reducing machine from a grinding configuration to a chipping configuration, the material reducing machine including a rotary component that is rotatable about an axis of rotation, the rotary component defining a grinding configuration boundary that extends at least partially around the axis of rotation, the method comprising:

mounting a boundary enlarging structure around the rotary component, the boundary enlarging structure defining a chipping configuration boundary that extends at least partially around the axis of rotation, the chipping configuration boundary being positioned outside the grinding configuration boundary; and mounting chipping knives to the rotary component, wherein the boundary enlarging structure assists in controlling a bite size of the chipping knives.

25. The method of claim 24, wherein the boundary enlarging structure includes a plurality of boundary enlarging segments, wherein the boundary enlarging structure is mounted to the rotary component by mounting the plurality of boundary enlarging segments to the rotary component, wherein the boundary enlarging segments are sized and shaped such that each boundary enlarging segments coincides with only a portion of a length of the rotary component and only a portion of a circumference of the rotary component, wherein the boundary enlarging segments are mounted to the rotary component with boundary defining surfaces of the boundary enlarging segments facing radially outwardly from the axis of rotation of the rotary component, and wherein the boundary defining surfaces cooperate to define the chipping configuration boundary of the material reducing machine.

* * * * *